US005196818A

United States Patent [19]

Anderson

[11] Patent Number: 5,196,818

[45] Date of Patent: Mar. 23, 1993

[54] WRIST MOUNTED MAGNETIC HOLDER

[76] Inventor: Steven P. Anderson, 6666 Reseda Blvd., #204, Reseda, Calif. 91355

[21] Appl. No.: 860,166

[22] Filed: Mar. 30, 1992

[51] Int. Cl.[5] ..... H01F 7/20; H01F 7/02; A45F 5/00

[52] U.S. Cl. ..... 335/285; 335/302; 223/109 A; 224/183

[58] Field of Search ..... 335/285-288, 335/295, 302, 303; 211/DIG. 1; 24/303; 7/901; 223/109 A; 224/183; 206/818; 269/8

[56] References Cited

U.S. PATENT DOCUMENTS

| | | | |
|---|---|---|---|
| D. 298,484 | 11/1988 | Austin | D3/22 |
| 2,152,897 | 4/1939 | Madore | 335/285 |
| 2,164,623 | 7/1939 | Posner | 335/285 |
| 2,176,052 | 10/1939 | Beyer | 335/285 |
| 2,904,364 | 9/1959 | Korodi | 335/285 |
| 2,970,857 | 2/1961 | Squire | 335/285 |
| 3,034,025 | 5/1962 | Budreck et al. | 335/285 |
| 3,257,141 | 6/1966 | Buus et al. | 335/285 |
| 3,755,857 | 9/1973 | Simoneaux | 24/303 |
| 4,315,568 | 2/1982 | Mojden | 335/306 |
| 4,325,504 | 4/1982 | Amani | 224/183 |

*Primary Examiner*—Leo P. Picard
*Assistant Examiner*—Raymond Barrera
*Attorney, Agent, or Firm*—Kelly Bauersfeld & Lowry

[57] ABSTRACT

A wrist mounted magnetic holder for small articles such as screws, nails, bolts, drill bits and the like having a non-ferrous material housing with a ceramic magnet polarized into two distinct regions and a flux concentrator for increasing the magnetic flux density at the holding surface.

14 Claims, 1 Drawing Sheet

WRIST MOUNTED MAGNETIC HOLDER

BACKGROUND OF THE INVENTION

This invention relates to a magnetic holder for use in releasably supporting small magnetically attractable objects, and more particularly, to a magnetic holder particularly adapted to be attached to the wrist or arm of a user for releasably holding small objects such as nuts, bolts, screws, nails, drill bits and the like for ready access.

There are many instances when it is desirable to have quick and ready access to small objects such as nails, screws, bolts, nuts, drill bits, and the like while a person is in the process of using both hands to perform some task such as drilling, screwing, nailing, or measuring. This is particularly true when a sequence of operations is being performed which requires that the person concentrate on the location of the next step to be performed, or when the person is in an inconvenient location such as on a ladder or in a confined space. In such situations, it would be desirable to have the needed supplies and tools close at hand and easily obtainable so that they may be located and obtained without having to use both hands, take ones eyes off the work spot, or leave the location. The present invention provides a wrist or arm mounted magnetic holder which permits small objects and tools to be kept close at hand to be quickly and easily obtainable.

SUMMARY OF THE INVENTION

The present invention provides a magnetic holder adapted to be attached to the wrist or lower arm of a user and which is light in weight and small in size, yet which provides an exceptionally strong magnetic force to permit even relatively small articles to be securely supported. The magnetic holder of the invention is constructed in such a manner as to insure that elongated objects such as nails, screws, bolts, drill bits and the like will lie flat and aligned with the users arm so as to prevent the possibility of injury to the user as he or she proceeds with the task at hand. Moreover, the magnetic holder of the present invention is relatively inexpensive to manufacture and assemble, yet is highly effective and reliable in use.

The magnetic holder of the invention includes a ceramic magnet supported in a rectangular housing having a suitable arm or wrist band attached thereto for permitting the holder to be worn by the user so that articles supported by the holder will be readily accessible. The magnet is polarized and mounted within the housing in such a manner as to concentrate the magnetic attractive force at the support surface, and to insure that elongated articles will lie flat on the surface and be aligned with the longitudinal direction of the housing. In this respect, the ceramic magnet is formed to have two regions of polarity so that longitudinally extending lines of flux are produced at the support surface, and a flux concentrator plate is provided to concentrate the magnetic flux at the support surface, thereby to increase the holding power of the device.

These and other features and advantages of the present invention will become more apparent from the following detailed description taken in conjunction with the accompanying drawings which disclose, by way of example, the principles of the invention.

DETAILED DESCRIPTION OF THE PREFERRED EMBODIMENT

Figure 1:
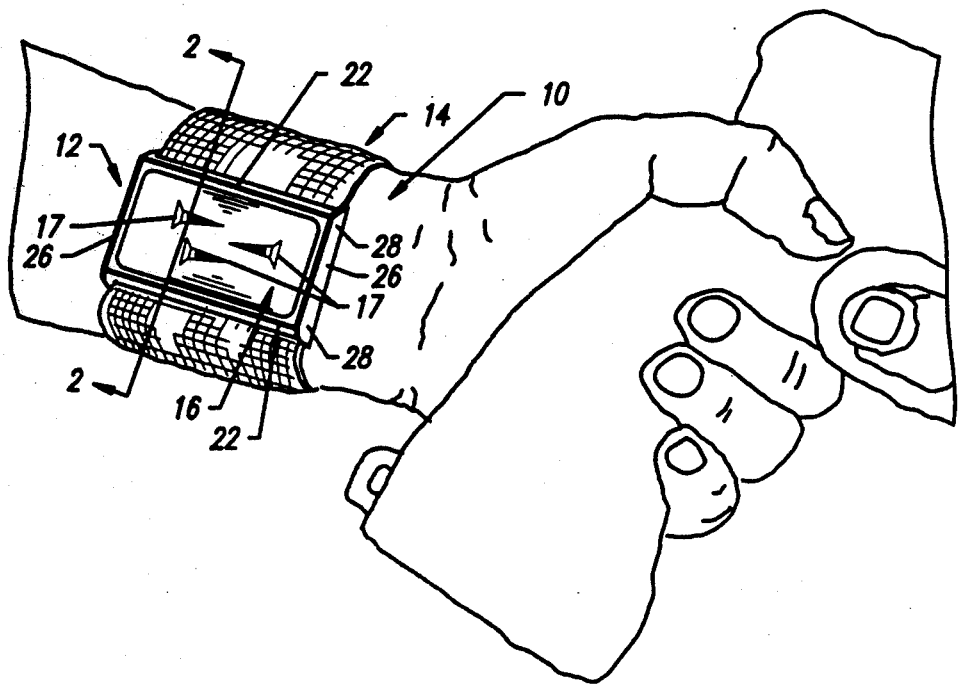
FIG. 1 is a fragmentary perspective view of a magnetic holder made in accordance with the present invention and illustrating the holder attached to the wrist or lower arm of a user.

As shown in the exemplary drawings, the present invention is embodied in a magnetic holder 10 adapted to be worn on the wrist of a user, and which is primarily intended to be used for releasably supporting and holding small objects such as nuts, bolts, nails, screws, and other magnetically attractable articles for ready and convenient user access. In this instance, the holder 10 includes as generally rectangular shaped housing 12 attached to a flexible wrist band 14 adapted to be secured around the wrist or lower arm of a user, and includes an outer generally rectangular flat face 16 on which magnetically attractable objects, herein shown as screws 17, can be supported. Preferably, the wrist band 14 is formed as two webs of heavy duty cloth each attached at one end to the opposite sides of the housing 12 so that the long dimension of the housing will lie generally parallel with the arm of the user. The ends of the two webs forming the wrist band 14 opposite the ends attached to the housing 12 preferably are provided with suitable cooperatively mating means (not shown), such as a Velcro fastening device, which can be used to secure the ends together about the user's wrist or arm.

In accordance with the present invention, the holder 10 is relatively light in weight and small in size, yet provides an exceptionally strong magnetic force to permit even relatively heavy articles to be securely supported on the face 16 of the housing 12, and the holder is constructed in such a manner as to insure that elongated articles such as nails, bolts, screws and the like will lie flat on the face with their long axis parallel to the long dimension of the face, rather than to project outwardly in a perpendicular direction which could create a potentially dangerous condition for the user. Moreover, the holder 10 of the present invention is relatively inexpensive to manufacture and assemble, yet is highly reliable and effective in use, and provides the user with a comfortable and convenient means to hold objects for ready use while leaving the users hands free to perform other tasks.

Figure 2:
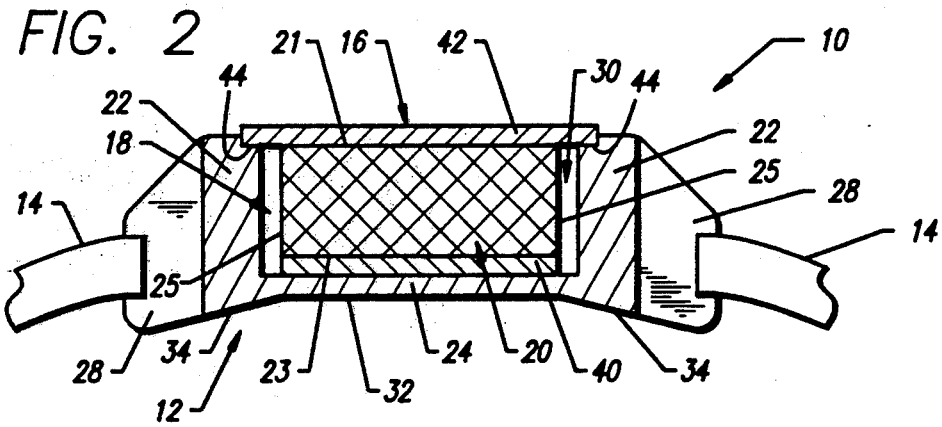
FIG. 2 is an enlarged fragmentary sectional view of the magnetic holder of FIG. 1 taken substantially in the direction of the line 2—2.
Figure 3:
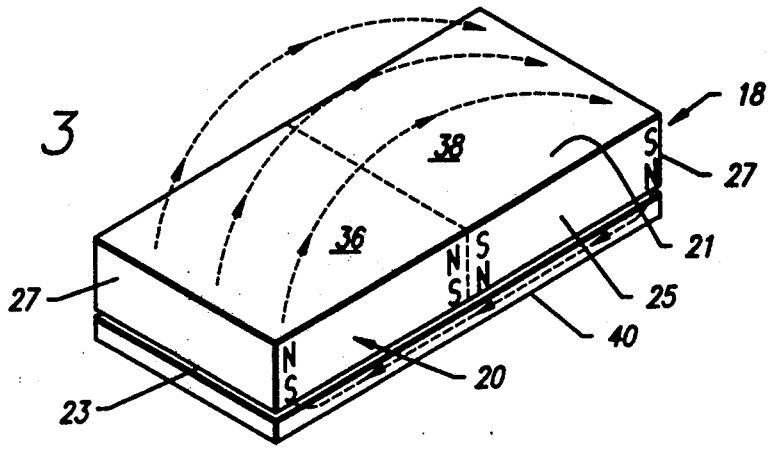
FIG. 3 is a perspective view of the ceramic magnet and flux concentrator plate used in the magnetic holder of FIG. 1, and including a schematic representation of the magnetic flux path.

Toward the foregoing ends, as best seen in FIGS. 2 and 3, the holder 10 employs a magnet 18 mounted within the housing 12 and formed from a generally rectangular shaped block 20 of a relatively light weight ceramic material such as strontium or barium ferrite, and having upper and lower substantially flat faces 21 and 23, respectively, spaced by transverse sidewalls 25 and end walls 27. The ceramic magnet 18 is polarized in such a manner that the magnetic lines of flux extend in a circular pattern longitudinally from one end of the block 20 to the other along its long dimension, and is mounted within the housing 12 so that articles attracted to the face 16 will tend to align themselves with the lines of flux and lie flat against the face. In this manner, elongated articles such as nails, screws and the like will tend to lie flat against the face 18 of the housing 12 with the long axis aligned with the long dimension of the magnet 18.

More particularly, the housing 12 is formed of a non-magnetic material such as cast aluminum or molded plastic, and herein is defined by spaced elongated and generally vertically extending sidewalls 22 interconnected by a bottom wall 24 and a pair of spaced vertical end walls 26, the end walls having wing-shaped extensions 28 for attaching the wrist band webs 14 along the sides of the housing. Defined centrally within the housing 12 between the sidewalls 22, end walls 26 and bottom wall 24 is a rectangular shaped, upwardly open cavity 30 within which is mounted the magnet 18. Herein, the lower surface 32 of the bottom wall 24 is contoured for comfortable fit with the arm or wrist of a user by having a generally horizontal central portion with downwardly sloping end portions 34 projecting from each side and which are aligned with the bottom edges of the wing-shaped extensions 22 of the end walls 26.

As represented in FIG. 3, the ceramic magnet 18 is herein formed as essentially two integral bar magnets disposed in side-by-side relation such that the block 20 is laterally divided into two regions of opposite polarity with substantially one half of the block having its "north pole" at the upper face 21 and "south pole" at the lower face 23 (herein the left half as seen in FIG. 3 and designated 36), and the adjacent half having its "south pole" at the upper face and "north pole" at the lower face (herein the right half as seen in FIG. 3 and designated 38). The resultant flux pattern, schematically illustrated by broken arrows in FIG. 3, thus extends longitudinally with respect to the long dimension of the block 20 so that magnetically responsive elongated articles will tend to be attracted to the magnet 18 in a direction generally aligned with the long direction of the magnet. It should be noted that the method used for formation of ceramic magnets to produce this type of polarization is well known in the art, and can, for example, be formed by applying a bi-polar magnetizing force to one half of the block 20 in one direction transverse to the longitudinal direction of the block through the upper and lower faces 21 and 23, and a second bi-polar magnetizing force to the other half in the opposite transverse direction, and forms no part of the present invention.

To concentrate the magnetic flux at the support surface 16 of the housing 12, a generally rectangular shaped ferrous plate 40, preferably made of carbon steel, is positioned over the lower face 23 of the block 20 between the magnet 18 and the bottom wall 24 of the housing. The flux concentrator plate 40 acts to reduce the flux leakage from the magnet 18 and increase the flux density at the surface 16 for enhancing the attractive magnetic force of the holder 10.

By enhancing the magnetic flux at the support surface 16, the magnetic attraction of the holder 10 is increased thereby producing an exceptionally strong magnetic force, and one which will result in articles placed at or near the sidewalls 22 and end walls 26 of the housing 12 tending to move more closely toward the center of the support surface 16.

To secure the magnet 18 and the concentrator plate 40 within the cavity 30, a relatively thin and rectangular shaped non-magnetic cover plate 42, herein a stainless steel plate, is positioned over the upper face 21 of the magnet. The cover plate 42 is dimensioned to overlie and close the open upper end of the cavity 30, and herein is secured to the sidewalls 22 and end walls 26 by a suitable bonding agent such as an epoxy adhesive, the sidewalls and end walls being provided with recessed areas defining support shoulders 44 for supporting the periphery of the cover plate so that it will be flush with the upper support surface 16 of the housing 12.

With the magnet 18 and flux concentrator 40 assembled within the cavity 30 of the housing 12 and the cover plate 42 secured, the holder 10 can be quickly and easily attached to the wrist or arm of a user by securing the wrist band 24. Due to the use of non-magnetic material for the housing 12 and the cover plate 42, and the provision of the flux concentrator plate 40, substantially all of the attractive magnetic force will be concentrated in the area of the support surface 16, and will be represented by longitudinal lines of flux extending in the long direction of the housing. Accordingly, magnetically attracted objects placed on or near the support surface 16 will tend to be attracted to the support surface and to align in the direction of the flux field. Thus elongated objects such as screws, bolts, nails and the like will lie flat against the support surface 16 and be aligned in the longitudinal direction rather than project outwardly in a direction perpendicular to the support surface or at sharp angles to the flux field. This substantially reduces the possibility of a user being injured by pointed objects held on the support surface 16.

From the foregoing, it should be apparent that the magnetic holder 10 for the present invention provides a reliable and effective wrist or arm mounted device which can be used to releasably hold magnetically attracted objects securely and safely for ready access while freeing the hands of a user to perform other tasks. While a particular form of the invention has been illustrated and described herein, it will be also apparent that various changes and modifications therein can be made without departing from the spirit and scope of the invention as defined by the following claims.

I claim:

1. A magnetic holder for releasably supporting magnetically attractable objects comprising:

a generally rectangular shaped housing formed of non-magnetic material and having longitudinal sides laterally spaced by interconnected end walls, said housing having a generally rectangular cavity formed therein;

a generally rectangular shaped magnet mounted within said cavity and having a generally flat upper face and a generally flat lower face, said magnet being divided laterally into two regions of reverse polarity with substantially one half of said upper face having one polarization and the other half having the opposite polarization;

a generally rectangular shaped concentrator plate of ferrous material disposed within said cavity between said lower face of said magnet and said housing; and a cover plate having a generally flat upper surface dimensioned to overlie said upper surface of said magnet and said cavity, said cover plate being formed of non-magnetic material and secured to said housing to retain said magnet and said concentrator plate within said cavity, said cover plate forming a support surface for supporting objects magnetically attracted to said holder.

2. A magnetic holder as set forth in claim 1 wherein said magnet is a ceramic magnet.

3. A magnetic holder as set forth in claim 2 wherein said ceramic material is strontium ferrite.

4. A magnetic holder as set forth in claim 2 wherein said ceramic material is barium ferrite.

5. A magnetic holder as set forth in claim 1 further including a flexible band attached to said housing for releasably securing said holder to an arm of a user.

6. A magnetic holder as set forth in claim 5 wherein said flexible band comprises a pair of fabric webs, each web having one end attached to a longitudinal side of said housing.

7. A magnetic holder as set forth in claim 5 wherein said magnet is a ceramic magnet.

8. A magnetic holder as set forth in claim 1 wherein said housing is formed of cast aluminum.

9. A magnetic holder as set forth in claim 1 wherein said cover plate is formed of stainless steel.

10. A magnetic holder as set forth in claim wherein said concentrator plate is formed of carbon steel.

11. A magnetic holder as set forth in claim 6 wherein said magnet is a ceramic magnet.

12. A magnetic holder as set forth in claim 11 wherein said housing is formed of cast aluminum.

13. A magnetic holder as set forth in claim 12 wherein said concentrator plate is formed of carbon steel.

14. A magnetic holder as set forth in claim 13 wherein said cover plate is formed of stainless steel.

* * * * *